United States Patent [19]

Pirie

[11] Patent Number: 4,754,499

[45] Date of Patent: Jul. 5, 1988

[54] GRIPPER PADS FOR HANDS

[76] Inventor: Lynne B. Pirie, 750 E. Thunderbird Rd., Suite 4, Phoenix, Ariz. 85022

[21] Appl. No.: 60,839

[22] Filed: Jun. 12, 1987

[51] Int. Cl.[4] ..... A41D 13/00

[52] U.S. Cl. ..... 2/20

[58] Field of Search ..... 2/16, 20, 161 R, 161 A

[56] References Cited

U.S. PATENT DOCUMENTS

| | | | |
|---|---|---|---|
| 2,547,388 | 4/1951 | Griffin | 2/20 |
| 3,398,951 | 8/1968 | Disko | 2/20 X |
| 3,735,442 | 5/1973 | Lukas | 2/20 X |
| 3,896,498 | 7/1975 | Pang | 2/20 |
| 4,617,684 | 10/1986 | Green et al. | 2/20 |

*Primary Examiner*—Louis K. Rimrodt
*Assistant Examiner*—Judith L. Olds
*Attorney, Agent, or Firm*—H. Gordon Shields

[57] ABSTRACT

Gripper pads for hands include a pad covering the palm area of a hand and finger loops on the pad through which four fingers extend for securing the gripper pad to a user's hand. The gripper pad is preferably made of a rubber material which has a relatively high coefficient of friction for maintaining a relatively non-slip grip on whatever is being held by the user.

7 Claims, 1 Drawing Sheet

GRIPPER PADS FOR HANDS

BACKGROUND OF THE INVENTION

1. Field of the Invention

This invention relates to gripper apparatus and, more particularly, to gripper pads secured to a user's hand to protect the hand and to allow the hand to maintain a firm, non-slip grip on an element held by the hand.

2. Description of the Prior Art

Various types of athletic or recreational events require a user to maintain a relatively tight grip on a generally cylindrical object, such as a weightlifting bar, a barbell, a water ski tow rope, etc. In the prior art, users either use nothing, or else they use gloves, wrist straps, or the like.

Gloves are relatively simple to use. The gloves generally cover the entire hand, including the fingers. In some cases, fingers are cut out of the glove, but the gloves typically cover the entire palm area, usually a portion of the fingers, and the back of the hand. Gloves become uncomfortable after a period of use, and eventually the gloves wrinkle, particularly in the palm area, due to sweat. The wrinkling usually results in callouses on the hand, or else direct irritation, and actually a loss of gripping power.

Wrist straps, on the other hand, are relatively cumbersome to put on and to take off. Moreover, they are also subject to some of the same deficiencies that gloves have.

The alternative is to use nothing. That is, a person would simply use the bare hand. The hand sweats and such sweating decreases the frictional engagement between the hand and whatever object is being held in the hand. This leads to slippage, and the like. Moreover, going barehanded results in callouses over a period of time. Such callouses are generally unsightly and are relatively undesirable in many cases, such as for office workers, physicians, dentists, and the like.

The apparatus of the present invention overcomes the deficiencies of the prior art.

Various types of gloves or glove-type elements have been used in the prior art in various types of athletic activities. For example, U.S. Pat. No. 368,724 (Loucks) discloses an early ballplayer's glove which simply includes a generally rectangular leather pad covering the palm area of a user's hand. There is a plurality of loops for the fingers aligned along one edge of the generally rectangular palm covering pad, and there is a loop at one side of the pad through which the thumb extends.

U.S. Pat. No. 1,066,696 (Baker) discloses a relatively large pad that covers the hand and which extends well beyond the hand sideways and frontwards. The pad, or paddle, as it actually is, includes loops for fingers and a thumb support. The apparatus is referred to as a paddle for swimmers.

U.S. Pat. No. 1,093,276 (Laser) discloses another type of swimming apparatus which is referred to as a glove. It includes a relatively large, generally rectangular pad with four finger pockets and a thumb pocket. The apparatus also includes a wrist strap.

U.S. Pat. No. 1,887,278 (Auster) discloses hand protector apparatus for golfers. The apparatus includes a generally rectangular strip that covers a portion of the user's palm, plus loops for the index finger and for the little fingerto hold the apparatus onto the hand. Another embodiment includes only a relatively small, generally rectangular, strip with a single loop through which the little finger extends. The apparatus is designed to cover only a portion of the palm of the hand. The portion of the palm covered is aligned with the little finger.

U.S. Pat. No. 2,547,388 (Griffin) discloses a glove apparatus which covers the entire hand and which includes four loops for the four fingers. The apparatus also includes an aperture through which the thumb extends. Two straps are used to secure the apparatus to the hand, one which passes over the wrist area and one which passes over the knuckle area of the hand.

U.S. Pat. No. 2,845,628 (Dell) discloses another type of semiglove for teaching ball control, designed primarily for basketball players. The apparatus covers the front portion of the palm of the hand and the corresponding back portion of the hand. The apparatus includes apertures through which the four fingers extend. It also includes a disc in the palm of the hand to help teach a basketball player to use the fingers for ball control, follow-through, etc.

U.S. Pat. No. 3,581,312 (Nickels) discloses a basketball training glove which covers the palm and back of the hand. The fingers extend outwardly from the apparatus, as does the thumb. The apparatus also includes an enlarged elastic member at the outer portion of the palm of the hand, adjacent to where the base of the fingers are. The purpose of the apparatus is to train a basketball player to use the tips of the fingers for controlling the ball.

U.S. Pat. No. 3,890,648 (Beal) discloses a protective device designed for baseball players. The apparatus covers a portion of the index finger and the area of the palm of the hand at the base of the middle and third fingers. The apparatus is designed to be used with a conventional glove to provide additional protection to a particular area of portion of the hand.

U.S. Pat. No. 3,896,498 (Pang) discloses a palm guard for protecting a portion of a palm of a user's hand. The apparatus covers a specific portion of the palm of a hand, generally the center portion of the palm of the hand. The apparatus includes straps that are disposed about the back of the hand, between the third and little fingers, and around the base of the thumb.

U.S. Pat. No. 4,487,412 (Meeko) discloses a weightlifting grip that includes a cradle which fits into the palm of the hand and which the fingers of a user extend over. The cradle is secured to a user's hand by means of a wrist strap. The cradle receives a bar, and the user's fingers are disposed about the cradle and thus about the bar.

SUMMARY OF THE INVENTION

The invention described and claimed herein comprises a resilient pad adapted to cover the palm area of a user's hand and which is adapted to be disposed about an element to be gripped during athletic or recreational exercise. The apparatus includes loops through which the fingers extend to secure the pads to a user's hand. The apparatus is preferably made of rubber or related elements having a relatively high coefficient of friction to aid the user in gripping.

Among the objects of the present invention are the following:

To provide new and useful gripper apparatus for hands;

To provide new and useful hand grips for protecting a user's hand;

To provide a pad for the hand of a user which includes loops through which fingers extend for securing the pad to a user's hand; and To provide new and useful gripper pad apparatus for a user's hand including a resilient pad covering substantially the entire palm area of a user.

DESCRIPTION OF THE PREFERRED EMBODIMENT

Figure 1:
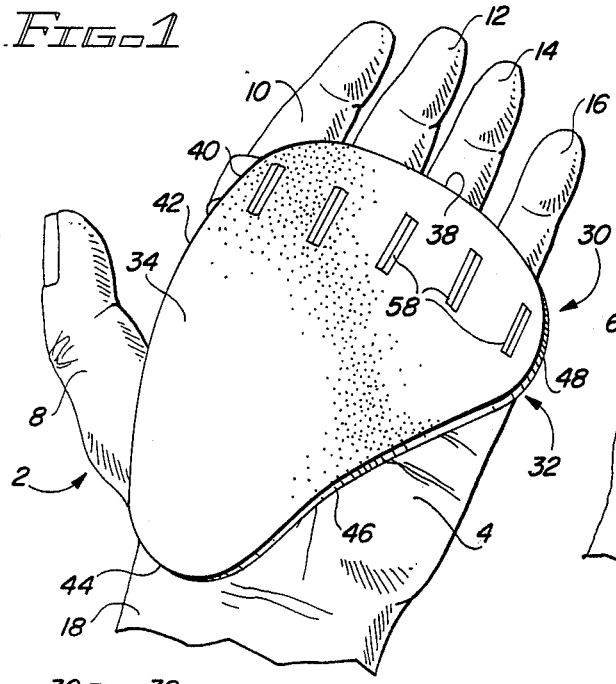
FIG. 1 is a perspective view of the apparatus of the present invention in its use position of the palm of the user's hand.
Figure 2:
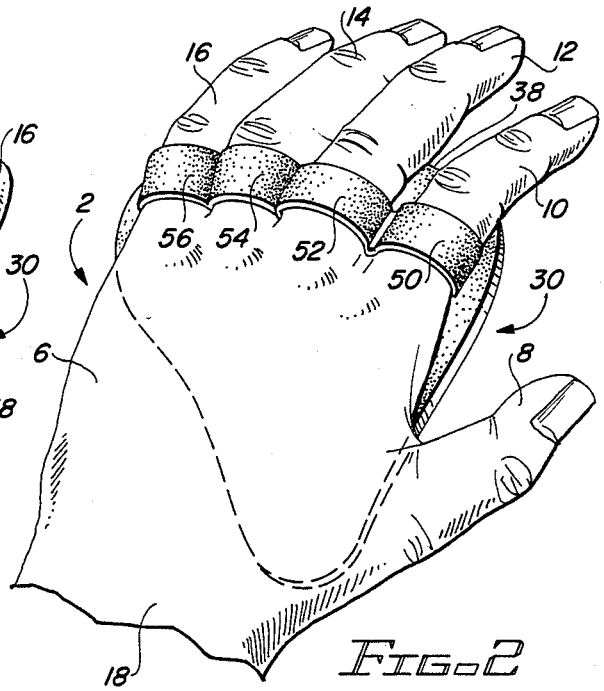
FIG. 2 is a perspective view of the back of the user's hand with the apparatus of the present invention secured to the hand.
Figure 3:
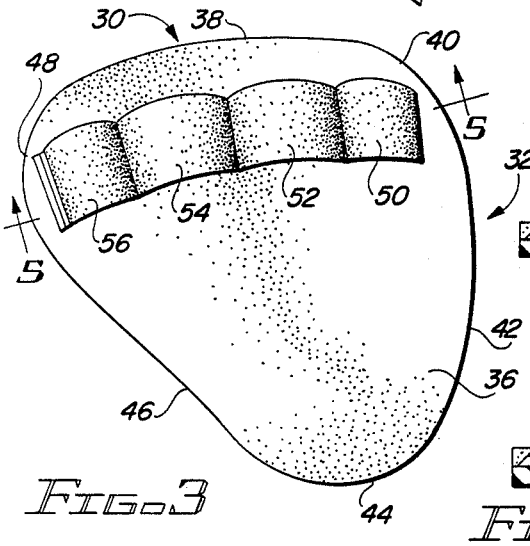
FIG. 3 is a rear plan view of the apparatus of the present invention.
Figure 5:
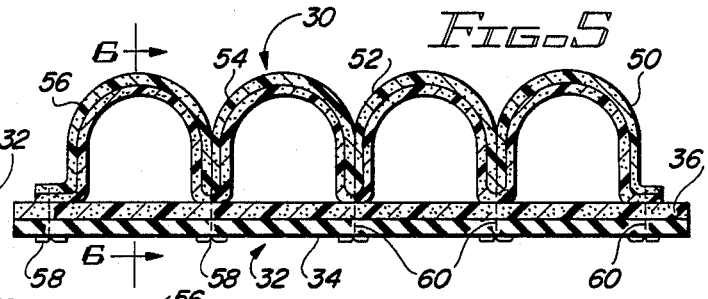
FIG. 5 is a view in partial section taken generally along line 5—5 of FIG. 3.
Figure 6:
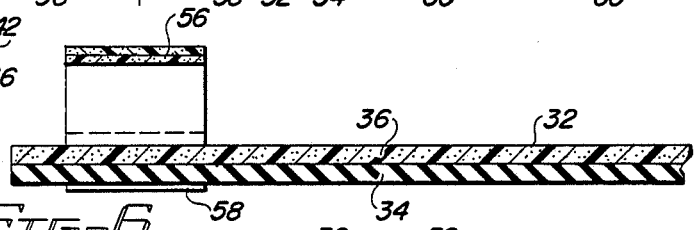
FIG. 6 is a view in partial section taken generally along line 6—6 of FIG. 5.
Figure 4:
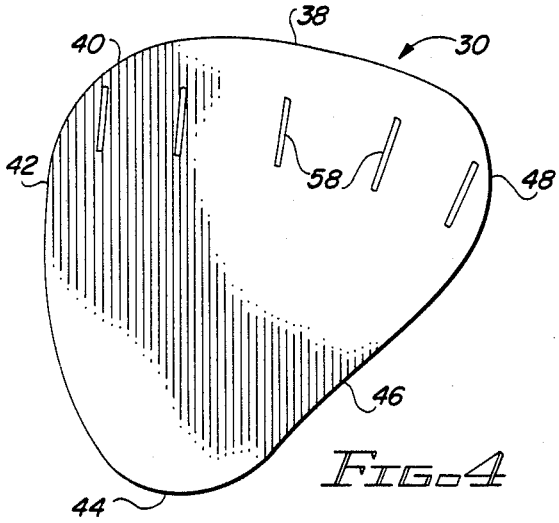
FIG. 4 is a front view of the apparatus of the present invention.
Figure 7:
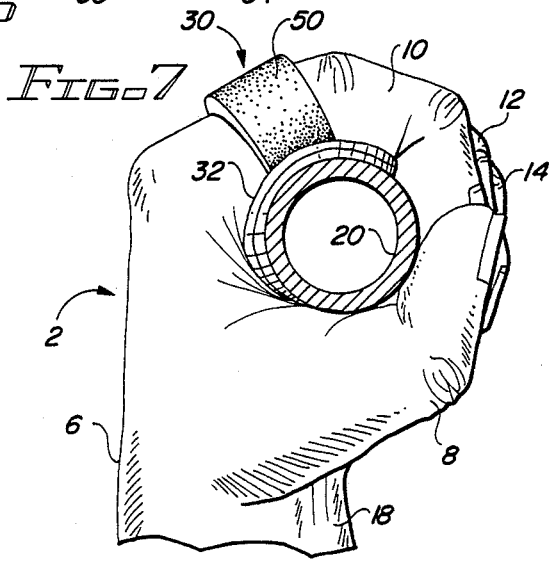
FIG. 7 is a side view in partial section illustrating the use of the apparatus of the present invention.

FIG. 1 is a perspective view of a hand 2 of a user with gripper pad apparatus 30 of the present invention secured to a front or palm portion 4 of a user's hand 2. FIG. 2 is a perspective view of the back of the hand 2 of the user with the gripper pad apparatus 30 secured thereto. FIG. 3 is a plan view of the back or rear side of the gripper pad apparatus 30 of the present invention. FIG. 4 is a plan view of the front of the gripper pad apparatus 30 of the present invention. FIG. 5 is a view in partial section of the gripper pad apparatus 30 of the present invention taken generally along line 5—5 of FIG. 3, through the pad apparatus and through finger loops which are used to secure the pad apparatus to a user's hand. FIG. 6 is a view in partial section of a portion of the gripper pad apparatus 30 of the present invention taken generally along line 6—6 of FIG. 5, through the pad apparatus and longitudinally through one of the finger loops. FIG. 7 is a side view of the gripper pad apparatus 30 shown in its use environment. For the following discussion, reference will be made to FIGS. 1-7.

The gripper pad apparatus 30 of the present invention includes a pad 32 which is of a generally triangular configuration, with rounded edges, and a plurality of finger loops for securing the pad 32 to the palm 4 of the user's hand 2. Thus, roughly, the general configuration of the gripper pad apparatus 30 is that of a gently rounded triangle. The gripper pad apparatus 30 includes a central pad 32, which is of the generally triangular configuration with rounded corners, and which, as best shown in FIGS. 5 and 6, includes two layers. The layers include a lower layer 34 and an upper layer 36. The lower layer 34 is preferably of neoprene rubber material adapted to provide a substantially non-slip grip on a weightlifting bar, such as a bar 20 shown in FIG. 7. In FIG. 7, the bar 20 is shown in section.

The upper layer 36 is preferably a nylon layer. The two layers are appropriately secured together, as by adhesive and by stitching at the outer periphery.

The pad 32, as best shown in FIGS. 1, 3, and 4, includes a top edge 38, a rounded corner 40, an inside edge or thumb edge 42, a rounded bottom 44, an outside edge 46, and an upper rounded corner 48. It will be noted that the top edge 38 is generally straight for a substantial distance, and that the inside or thumb edge 42 is also generally straight, but is slightly convex over its length. The bottom 44 is a relatively short, gently rounded edge or corner. The slanted outside edge 46 is slightly concave. The term "slanted" refers to the fact that the angle between the top edge 38 and the inside edge 42 is nearly a right angle, although the connecting corner 40 has a substantial radius of curvature, and the angle between the outside edge 46 and the top edge 38 is substantially less than perpendicular. Similarly, the angle between the inside edge 42 and the slanted outside edge 46 is substantially less than a right angle. Thus, the three edges 38, 42, and 46 define almost a triangle, with the bottom edge or corner 44 being a broadly rounded apex, and with the top edge 38, referred to as the top edge because it is adjacent to the fingers of a user's hand, being essentially the base of the triangle.

For securing the pad 32 to a user's hand, four finger loops are used. The finger loops include an index finger loop 50, a middle finger loop 52, a third finger loop 54, and a little finger loop 56. The finger loops 50 . . . 56 are appropriately stitched through the upper and lower layers 34 and 36 of the pad 32. This is shown best in FIGS. 4, 5, and 6.

Reinforcement patches 58 are disposed on the lower layer 34 adjacent to stitching 60. The stitching 60 secures the individual loops to the pad 32. In actuality, the loops 50 . . . 56 simply comprise a single piece of neoprene rubber-nylon material out of which the pad 32 is made, formed into the four loops and appropriately stitched to the pad 32.

In FIGS. 1, 2, and 7, the user's hand 2 is shown with the gripper pad apparatus 30 secured to the palm 4 of the hand 2. The user's hand 2 includes a back 6, and a thumb 8, an index finger 10, a middle finger 12, a third finger 14, and a little finger 16. A portion of a wrist 18 is also shown in FIGS. 1, 2, and 7.

In FIG. 1, the gripper pad apparatus 30 is shown secured to the user's hand 2, with the pad 32 disposed over the palm 4. The edge 42 of the pad 32 extends generally between the index finger 10 and the wrist 18, and past the thumb 8. The lower or bottom edge 44 is disposed at about the juncture of the thumb 8 and the wrist 18. The slanted outside edge 46 extends generally from the thumb and wrist juncture and from the bottom edge 42 generally diagonally across the palm 4 to about the first joint of the little finger 16. The upper edge 38 is shown extending upwardly beyond the palm 4 of the hand 2, and extending upwardly onto the fingers, at about the first joint of the fingers.

In FIG. 2, the index finger 10 of the user's hand 2 is shown extending through the index finger loop 50. The middle finger 12 is shown extending through the middle finger loop 52, and the third finger 14 is shown extending through the third finger loop 54. The little finger 16 is shown extending through the little finger loop 56. The loops 50 . . . 56 are shown disposed at about the base of the fingers. This allows the top edge 38 of the pad 30 to extend up to the knuckles of the fingers, or about to the first joints of the finger.

In FIG. 7, the hand 2 is shown disposed about the bar 20, with the gripper pad apparatus 30 disposed on the user's hand, and disposed about the bar 20 to reinforce and to help secure the bar 20 in the grip of the hand 2. The user's index finger 10 is shown extending through the index finger loop 50, which is in turn secured to the pad 32.

The lower neoprene rubber layer 34 has a relatively high coefficient of friction, and thus allows the user to securely grip the bar 20. As is known and understood, upon exercise, the hand sweats, and the palm 4 accordingly becomes moist, and the moisture decreases the effectiveness of the grip of the hand 2 upon any bar or upon anything else that a user is working out with. With respect to a weight or weight bar, such as the bar 20, the possibility of the bar slipping increases with an increase in the weight being used and with the moisture of the palm. In other words, the likelihood of a slip is directly related to the decrease in the coefficient of friction of the hand with the bar, and to the weight being used. With the gripper pad apparatus 30 of the present invention, regardless of the sweating or the low coefficient of friction of the palm for the hand 2, the grip is maintained since the palm 4 does not directly contact the bar. Rather, the lower neoprene layer 34 of the pad 32 contacts the bar to maintain a grip on the bar.

It will be noted that the back 6 of the hand 2 is substantially free from the gripper pad apparatus 30. The only contact with the back of the hand and the gripper pad apparatus 30 is at the base of the fingers and then only on the relatively narrow finger loops. This is, of course, contrasting with gloves, in which the back of the hand, and in some cases a substantial portion of the fingers, are covered by portions of the glove. In addition, the combination of the lower neoprene layer 34 and the upper nylon layer 36 provides substantially greater padding than is generally available in gloves. Finally, the general configuration of the pad 32, in the form of a generally rounded triangle, in concert with the material out of which the pad is made, provides a pad that will neither harden nor bunch nor crease in the user's hand. The neoprene remains resilient with a substantially high coefficient of friction regardless of the circumstances of the individual grip. Since there is virtually nothing to bunch, no creases result which may cause callouses or other problems either with the user's hand 2 or for the grip, as is common with gloves. This is particularly true when any particular gloves are used over a period of time. The gloves get hard due to the absorption of sweat from the hand, and due to the curvature of the gloves over the bar, the palm area generally, in time, bunches up and creases, causing discomfort, etc., in the palm. The apparatus of the present invention is not subject to such problems due to its inherent nature and due to its particular design.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Gripper pad apparatus for use in gripping a bar by a user's hand, which hand includes a palm, a thumb, and fingers, comprising, in combination:

resilient pad means, including a resilient pad covering a substantial portion of the user's palm and a portion of the user's fingers, including the first joints; and means for securing the pad to the user's hand.

2. The apparatus of claim 1 in which the means for securing the pad to the user's hand includes a plurality of loops through which the fingers extend.

3. The apparatus of claim 1 in which the pad of the pad means is of a generally triangular configuration.

4. The apparatus of claim 3 in which the pad means includes a first edge extending generally along the inside of the user's hand between the thumb and the fingers, a second edge extending generally along the fingers from the inside to the outside of the hand, and a third edge extending generally diagonally across the palm of the hand.

5. The apparatus of claim 4 in which the means for securing the pad to the user's hand includes a plurality of loops for receiving the user's fingers, and the loops are disposed adjacent to, but slightly apart from, the second edge of the pad.

6. The apparatus of claim 1 in which the pad of the pad means includes a first layer of material having a relatively high coefficient of friction so as to grip a bar regardless of the circumstances of the user's grip.

7. The apparatus of claim 6 in which the pad of the pad means includes a second layer of material secured to the first layer of material, and the user's hand contacts the second layer of material.

* * * * *